United States Patent [19]

Sielaff

[11] Patent Number: 4,505,358

[45] Date of Patent: Mar. 19, 1985

[54] VOICE COMMUNICATOR

[76] Inventor: Ulrich Sielaff, 118 Vaughn Ct., Madison, Wis. 53705

[21] Appl. No.: 549,743

[22] Filed: Nov. 8, 1983

Related U.S. Application Data

[63] Continuation of Ser. No. 338,516, Jan. 11, 1982, abandoned.

[51] Int. Cl.[3] ..... G10K 11/12

[52] U.S. Cl. ..... 181/18; 179/100 D; 179/179; 181/19; 181/20; 446/141

[58] Field of Search ..... 46/33, 44; 179/100 R, 179/103, 179, 182 R, 182 A, 100 D; 181/18, 19, 20, 21, 22; 446/141, 142

[56] References Cited

U.S. PATENT DOCUMENTS

| | | | |
|---|---|---|---|
| 278,411 | 5/1983 | Dickson | 181/18 |
| 762,900 | 6/1904 | Graybill | 181/18 |
| 1,777,427 | 10/1930 | Bregman | 46/33 |
| 1,867,200 | 7/1932 | Adams | 181/20 |
| 2,633,769 | 4/1953 | Saks | 46/33 |
| 3,022,387 | 2/1962 | Bair | 179/182 A |
| 3,769,744 | 11/1973 | Sloane, Jr. et al. | 46/33 |
| 4,090,042 | 5/1978 | Larkin | 181/20 |

FOREIGN PATENT DOCUMENTS

| | | | |
|---|---|---|---|
| 311912 | 10/1930 | Fed. Rep. of Germany | 181/18 |
| 2155330 | 5/1973 | Fed. Rep. of Germany | 179/182 |
| 427939 | 8/1911 | France | 181/18 |
| 500922 | 12/1921 | France | 181/18 |
| 645103 | 10/1928 | France | 181/18 |
| 679502 | 1/1930 | France | 181/22 |
| 548228 | 9/1956 | Italy | 181/18 |

*Primary Examiner*—Gene Z. Rubinson
*Assistant Examiner*—Randall P. Myers
*Attorney, Agent, or Firm*—Keith Schoff

[57] ABSTRACT

Direct voice communication with simultaneous two-way transmission is possible with a communicator having the earpiece of the communicator at one station connected by flexible plastic tubing to the mouthpiece of a communicator at another station, the two stations being connected by two independent voice channel tubes. The provision of cross-connected channels between the mouthpiece and the earpiece of two communicating stations permits normal conversation with simultaneous two-way transmission to occur in the manner of telephonic transmission rather than requiring sequentially alternating transmission between stations as necessary in using single voice tube communicators where destructive interference occurs between sound waves transmitted simultaneously in opposite directions in a voice tube.

5 Claims, 4 Drawing Figures

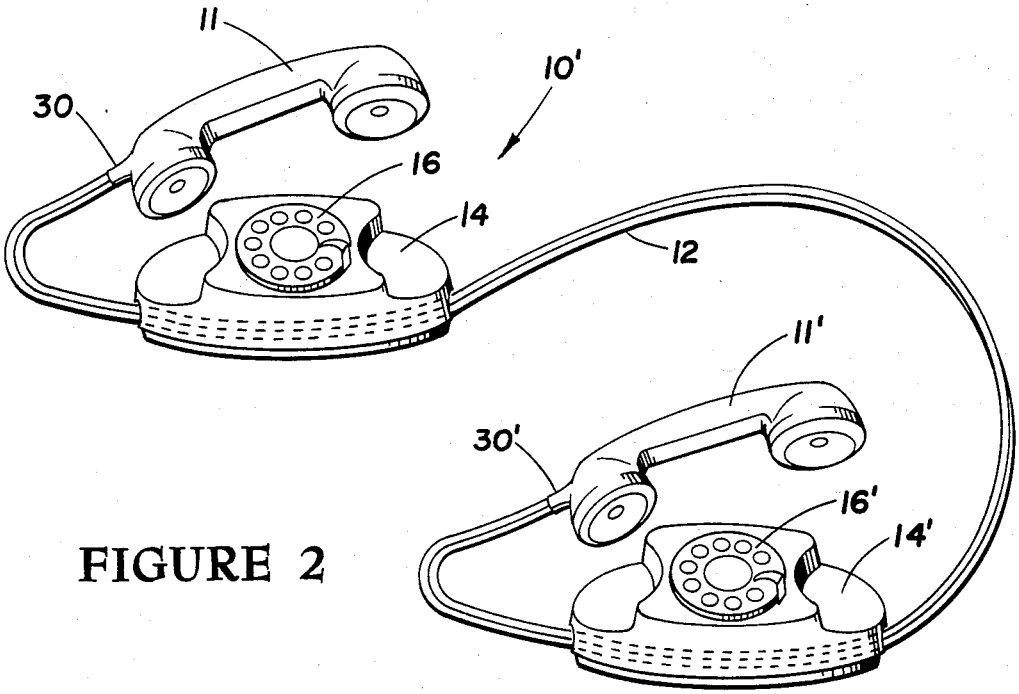
FIGURE 2
FIGURE 3
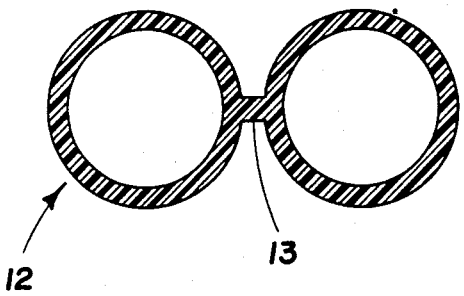

VOICE COMMUNICATOR

This application is a continuation of Ser. No. 338,516, Jan. 11, 1982; now abandoned.

BACKGROUND OF THE INVENTION

Use of single voice tube communicators has long been known for use in commercial boildings where individual apartments or offices have been fitted with terminal stations, and in shipboard application between bridge and engine room. Dual sound transmitting tubes have been employed widely on commercial airliners to terminal stations at individual passenger seats for acoustic transmission of electronically reproduced stereophonic music wherein a headset is furnished with one tube connected to either earpiece of the headset.

FIELD OF ART

Single tube, direct voice communicators, sound powered telephones, intercoms, and radio transceivers such as "walkie-talkies" all require user participation in the signal system logic, either by alternately sequencing transmissions between stations, or by a terminal piece or electro-acoustic transducer being moved between ear and mouth positions of the user, or by "on-off" or "push-to-talk" switch actuation. Particularly in children's toys, elimination of user input to system logic is desirable, whatever the kind of alternation involved.

PRIOR ART

U.S. Pat. Nos. 765,900 and 1,177,427 and 1,687,200 each disclose a single voice tube of flexible rubber serving to both transmit and receive voice communication which originates at each of two connected stations. U.S. Pat. No. 278,411 shows dual connecting tube pairs provided to extend telephonic communication in a building to locations remote from the site of a telephone serving the building with one tube arranged to interconnect the telephone mouthpiece with the mouthpiece at the extension location and the other tube arranged to interconnect the two earpieces.

SUMMARY OF THE INVENTION

The embodiment of the invention disclosed herein is described as a child's toy embodying a pair of simulated telephone handsets connected by a dual bore extruded polyvinyl chloride "cord" wherein each bore of the connector comprises an independent voice tube, a novel feature of the device being that the voice tubes are cross-connected earpiece-to-mouthpiece between handsets and provide for simultaneous voice transmission from each handset as differentiated from the conventional arrangement in which two-way conversation becomes intelligible in a single voice tube only when transmission from each of the tube terminals is commenced sequentially and not simultaneously to avoid destructive interference between acoustic waves propagated to travel in opposite directions along the same axis and consequent garbling of transmission.

The invention has utility in applications other than toys, however, and may be used as an intercommunication system in a building or vessel or other location where relatively short distance voice communication to isolated spaces is desired. The invention is uniquely suited for use in simultaneous translation where a live or recorded transmission may be directed into a mouthpiece of one handset and be received back in the earpiece of the same set in different form as provided by a translator or encoder utilizing a connected handset. Other "real time" applications such as use with computer terminals are also possible. With increase in tube size, the range of acoustic transmission is also increased.

While the preferred embodiment is described as having apertures in the handsets providing direct communication with the bore of the tube, it is possible, and may be preferred in some applications including toys, to provide a diaphragm in the aperture whether to prevent a child from blowing through the tube or to produce amplification. Electrical or acoustical amplication means might also be provided, if desired.

DESCRIPTION OF THE DRAWINGS

FIG. 2 is a perspective view of a toy telephone set embodying the apparatus of FIG. 1;

FIG. 3 is a cross-sectional elevation of a preferred embodiment of dual tubular bore connecting means shown in FIGS. 1 and 2.

DESCRIPTION OF THE INVENTION

Figure 1:
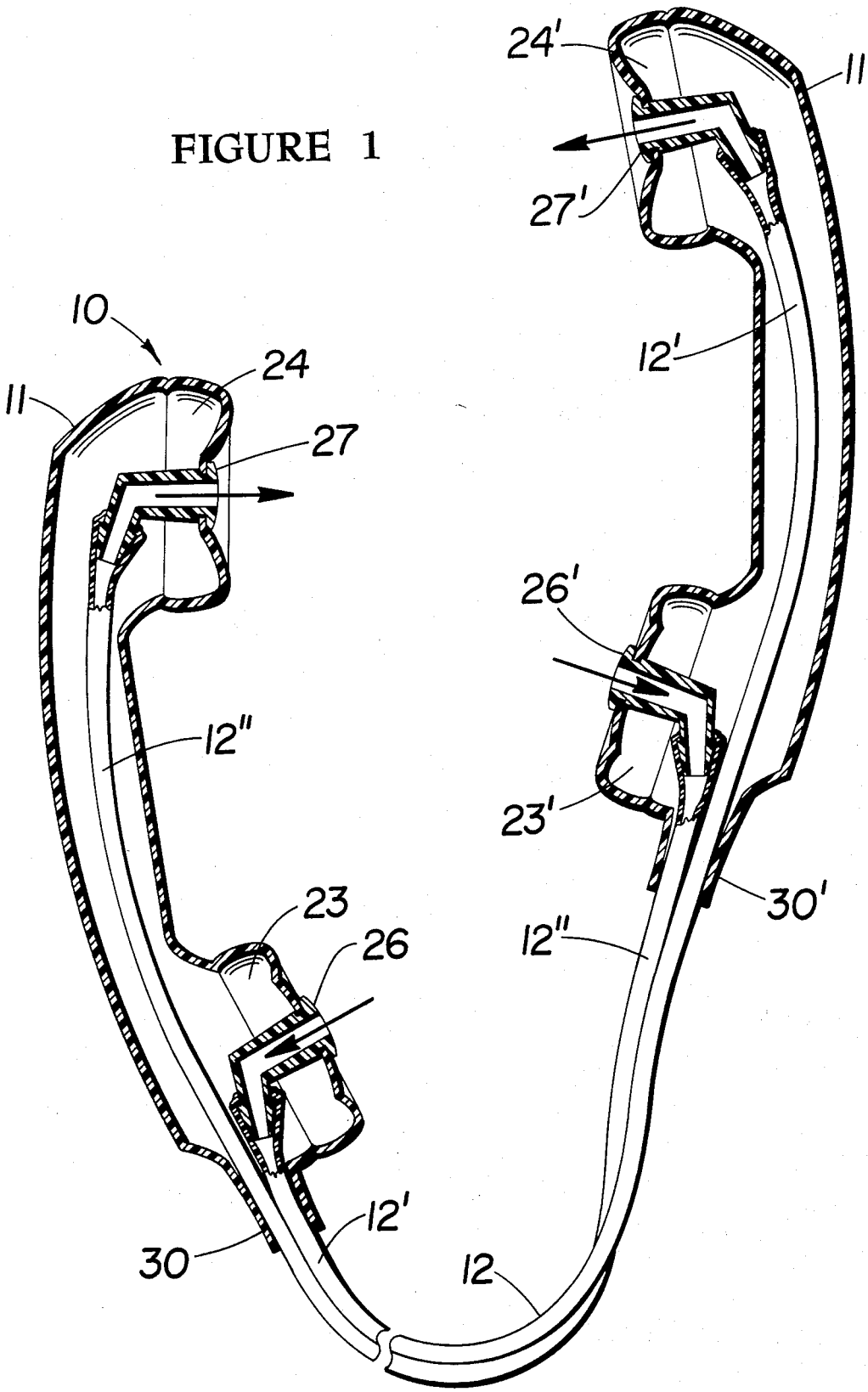
FIG. 1 is an elevation in partial section of one embodiment of a communicator of this invention.

In FIG. 1, toy telephone handset pair 10 is shown embodying two blow molded identically configured handsets 11 and 11' connected by dual tubular connector 12, which as shown in FIG. 3 is configured with two tubular bores 12' and 12'' preferably of about 7/32 inch diameter each. A thin web of material 13 which may be easily torn separates the dual tubes of connector 12. Any suitable material may be used for the handsets and connector, a preferred choice of polymeric synthetic resin materials being low density polyethylene for the handsets, polyvinylcholoide for the connector and medium impact polystyrene for terminal pieces 26, 26', 27, and 27', the latter terminal pieces being fitted, respectively, in face openings in mouthpiece portions 23, 23' and earpiece portions 24, 24' of handsets 11, 11'. The terminal pieces shown snap-in and are configured with tubing fittings of conventional design at the extremity disposed within the handset, such as conically fluted belted sections on the outer peripheral surface for receiving expansible tubing thereover. Connector 12 is operably attached to terminal pieces 26, 26', 27, and 27' by the two tubular portions of the connector being separated within the body of the handset with bore 12' interconnecting mouthpiece terminal 26 of handset 11 with earpiece terminal 27' of handset 11', and conversely, with bore 12'' interconnecting mouthpiece terminal 26' of handset 11' with earpiece terminal 27 of handset 11. Thus connected, transmission from each of the handsets can occur simultaneously without reception at the earpieces being garbled in contrast to communicators having a single voice tube in which garbled communication occurs by oppositely traveling sound waves, i.e. air pressure fronts, destructively interfering if simultaneous two-way transmission is attempted.

For voice tube transmission greater than about twenty-five feet distance, the bores of connector 12 may be increased in size up to about three-quarters inch. Any suitable material, whether elastomeric, plastomeric or relatively rigid composition my be used for connector 12.

Terminal pieces 26, 26', 27 and 27' are shown in FIG. 1 to have an open bore extending therethrough as indicated by the arrows signifying direction of sound propagation, however, a diaphragm, not shown, may be provided in the terminal pieces to isolate the air in the confines of the bores 12' and 12'' from free atmosphere without significantly affecting sound transmission. Such diaphragms must be enabled to be biased responsively to impinging pressure fronts of sound waves emanating from the mouth of a user or other similar source, the use of such diaphragms in voice tube communicators being known art. Similarly, if desired, electrical amplification of an acoustic signal could be provided at the terminal sites of bores 12' and 12'' without departing from the scope of this invention, such means for boosting signal energy being well known as including a coupled microphone and speaker emitting an amplified signal. Such means could include sound powered amplification as well as battery or line current powered amplifiers, but in all cases communication between terminal handsets would be by propagation of acoustic waves.

Figure 4:
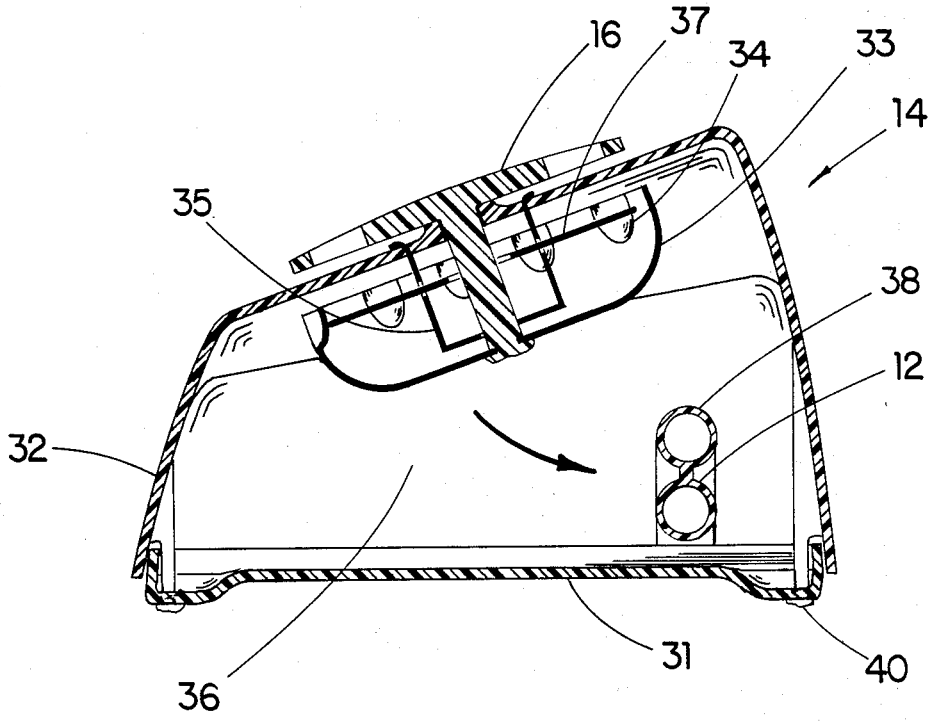
FIG. 4 is a cross-sectional side elevation of the toy telephone base member shown in FIG. 2.

In FIG. 2, toy telephone 10' incorporates handset pair 10 of FIG. 1 and includes, as well, telehpone base member replicas 14, and 14' equipped with dialing devices 16, and 16', which when manually dialed ring bell means housed in the base members. The base members comprise no functional part of the voice communicating means of this invention and only add to the appearance of authenticity of the toy telephone set. Connector 12 is shown to be passed through base members 14, 14' without being pierced or interrupted. Base member replica 14 comprises sounding chamber 36 formed by base cover 31 attached to enclosure 32 by studs 40 as shown in FIG. 4. The effect of the sounding chamber is to transmit to connector 12, which is frictionally retained in contact with enclosure 32 by being pressed into opening 38 at the base of the enclosure wall, vibrations emanating from ringing of the bell means when dialing device 16 is manipulated. Acoustic coupling occurs in three manners between the bell means and the connector, mamely, by vibrations being transmitted through the solid wall of enclosure 32 and of connector 12 in contact therewith, and through air in the confinement of cavity 36 to connector 12 which passes through the cavity, and through air via an opening hidden from view under the finger stop of dialing device 16 directly into the earpiece of handset 11 as shown in FIG. 2 and through one of bores 12', 12'' when the handset is raised as shown in FIG. 2 for conveniently operating dialing device 16. The higher frequencies of the ringing sound are best transmitted by air coupling to the bore of connector 12, however, the lower frequency mechanical component frequencies, more like that of a buzzer, are best transmitted by vibrations induced in the wall of the connector through solid connection and within the confine of the sounding chamber and are best heard at extended distances of connector 12, compared to the higher frequency sounds of ringing. The bell means comprises dome shaped resonator 33 affixed to rotate with dialing device 16 and configured with peripheral indentations 34 which repeatedly hit stationary clapper 37 when the dialing device is rotated. Mounting yoke 35 transmits vibrations directly to enclosure 32.

Cord flanges 30 and 30' are shown on handsets 11 and 11' to prevent crimping of connector 12 and relieve strain when the connector 12 is tightly drawn. While handsets 11 and 11' are described and shown as being blow molded, any other forming method may be employed, and if the handsets are injection molded it may be expedient to provide integrally molded voice channels within the handsets and eliminate either or both of the portion of connector 12 shown disposed in the handsets 11 and 11' in FIG. 1 and the terminal pieces 26, 26', 27 and 27', as will be apparent to one skilled in the art, however, such means are not shown.

If desired, more than two terminal stations may be provided and be interconnected by a connector having multiple tubular pair sets, the mouthpiece and earpiece terminal members of each handset then having multiple tubing connection locations for providing one tube passage from each mouthpiece and each earpiece of each handset in the system to each of the other earpieces and each of the other mouthpieces of the communicating terminal stations, respectively. Such a multiple station system is particularly appropriate for use as an intercom system having stations in various locations in a building and might incorporate a signaling system as heretofore has been known for use with voice tube communicators for requesting a particular station to answer.

I claim:

1. Acoustic transmission apparatus for simultaneous two way voice communication comprising enlogated connector means configured to provide at least two continuous passages linearly extending therethrough wherein said connector means is substantially more than eight feet in length, unitary, without cross connection, at least two hand sets each having a mouthpiece portion and an earpiece portion wherein said mouthpiece portion and said earpiece portion each is configured with an opening disposed in the face thereof of a diameter constituting a minor fraction of said face diameter, said hand sets being unitarily hollow, a plurality of terminal pieces disposed one each in said mouthpiece portion opening and said earpiece portion opening of each said hand set wherein each said terminal piece is configured with a substantially tubular bore therethrough without bell shape and of a size which restricts possible invasion thereof by a user such as a child inserting a digital extremity and wherein each said terminal piece is configured with one end extremity insertable into an end portion of one of said passages in said connector means for communicating such passages through said face openings of said hand sets to ambient unconfined environment and without extension of said passages, said terminal pieces being connected to opposite end portions of said conector means by said mouthpiece portion disposed terminal piece of one said hand set being interconnected by a portion of said connector means comprising one said passage to said earpiece portion disposed terminal piece of another said hand set, and said mouthpiece portion disposed terminal piece of said another hand set being interconnected by another portion of said connector means comprising another said passage to said earpiece disposed terminal piece of said one handset, thereby providing sustantial isolated acoustical cross connection of the mouthpiece disposed terminal piece of said one handset with the earpiece portion disposed terminal piece of another said hand set, at least two base sets on which said hand sets can be cradled, each said base set comprising a sounding means which can be actuated to transmit such sound through said connector means to one said hand set when another said hand set sounding means is actuated, each said base set comprising a closed cavity through which said connector means passes and makes contact, said sounding means comprising a resonator which is caused to make repeated intermittent contact with clapper means when operably actuated thereby causing vibrations to be imparted to said connector means through the walls and through the confines of said cavity.

2. The apparatus of claim 1 wherein said handsets are blow molded.

3. The apparatus of claim 1 wherein said terminal pieces snap in said mouthpiece portion and said earpiece portion openings.

4. The apparatus of claim 1 wherein said terminal pieces are configured each with a conically fluted belted extremity of the outer peripheral surface for receiving said connector means.

5. The apparatus of claim 1 wherein said hand sets are configured with a geometry which disposes said mouthpiece portion disposed terminal piece and said earpiece portion disposed terminal piece to approximately match the anatomical location of the mouth and the ear of a user.

* * * * *